US007511727B2

(12) United States Patent
Nishida

(10) Patent No.: US 7,511,727 B2
(45) Date of Patent: Mar. 31, 2009

(54) FIXATION HEATER CONTROL METHOD AND IMAGE FORMATION DEVICE

(75) Inventor: Yoshiaki Nishida, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 251 days.

(21) Appl. No.: 10/596,539

(22) PCT Filed: Dec. 27, 2004

(86) PCT No.: PCT/JP2004/019535

§ 371 (c)(1),
(2), (4) Date: Jun. 15, 2006

(87) PCT Pub. No.: WO2005/064419

PCT Pub. Date: Jul. 14, 2005

(65) Prior Publication Data

US 2007/0116485 A1 May 24, 2007

(30) Foreign Application Priority Data

Dec. 26, 2003 (JP) ..... 2003-435233

(51) Int. Cl.
*G03G 15/20* (2006.01)

(52) U.S. Cl. ..... 347/156; 399/69

(58) Field of Classification Search ..... 347/156; 399/67, 69

See application file for complete search history.

(56) References Cited

U.S. PATENT DOCUMENTS 5,994,671 A * 11/1999 Suzuki et al. ..... 219/216
6,301,454 B1 * 10/2001 Nishida et al. ..... 399/69
6,853,818 B2 * 2/2005 Nishida ..... 399/67

FOREIGN PATENT DOCUMENTS

| | | |
|---|---|---|
| JP | 5-100755 | 4/1993 |
| JP | 9-244466 | 9/1997 |
| JP | 10-010917 | 1/1998 |

(Continued)

OTHER PUBLICATIONS

Computer-generated translation of JP 2003-123941 cited in the IDS filed on Jun. 15, 2006.*

(Continued)

*Primary Examiner*—Huan H Tran
(74) *Attorney, Agent, or Firm*—patenttm.us

(57) ABSTRACT

The present invention employs novel phase control for a fixing heater, which uses first and second heaters, to reduce the generation of a higher harmonic wave current and a power line terminal noise. With four consecutive half wavelengths (two cycles) of a power supply voltage employed as a period, two half waves are used for phase control and other two half waves are made full ON or full OFF for each of the first and second heaters and, at the same time, the phase control is performed complimentarily to both the heaters. That is, for each half wave, when the power is turned on with the phase control of one heater, the other heater is made full ON or full OFF. This causes turn-on switching to occur only on at most one heater in a half wave period. As a result, as compared with usual phase control, a power-supply higher-harmonic-wave current and a power line terminal noise are reduced.

6 Claims, 10 Drawing Sheets

FOREIGN PATENT DOCUMENTS

| | | |
|---|---|---|
| JP | 11-95611 | 4/1999 |
| JP | 11-272103 | 10/1999 |
| JP | 2000-47520 | 2/2000 |
| JP | 2002-50450 | 2/2002 |
| JP | 2003-123941 | 4/2003 |

OTHER PUBLICATIONS

Computer-generated translation of JP 11-095611 cited in the IDS filed on Jun. 15, 2006.*

* cited by examiner

PATTERN 1

PATTERN 2

FIG. 5-A (a)
100%
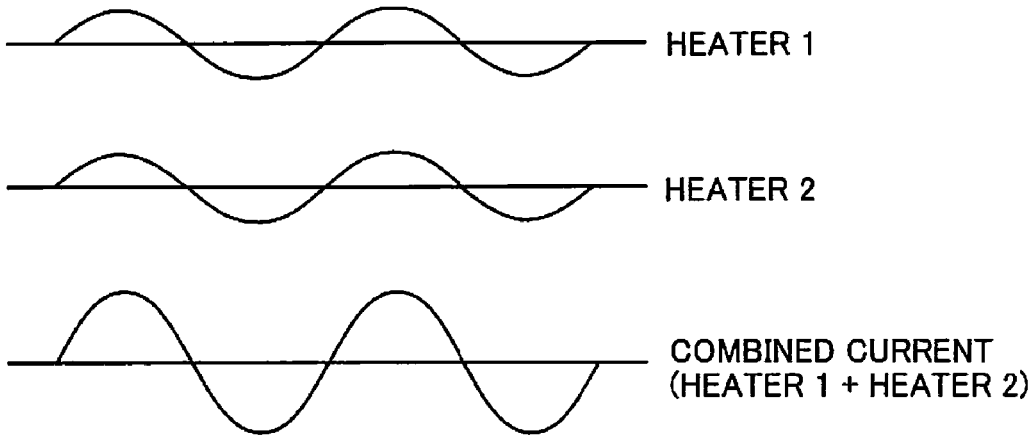
FIG. 5-A (b)
75%
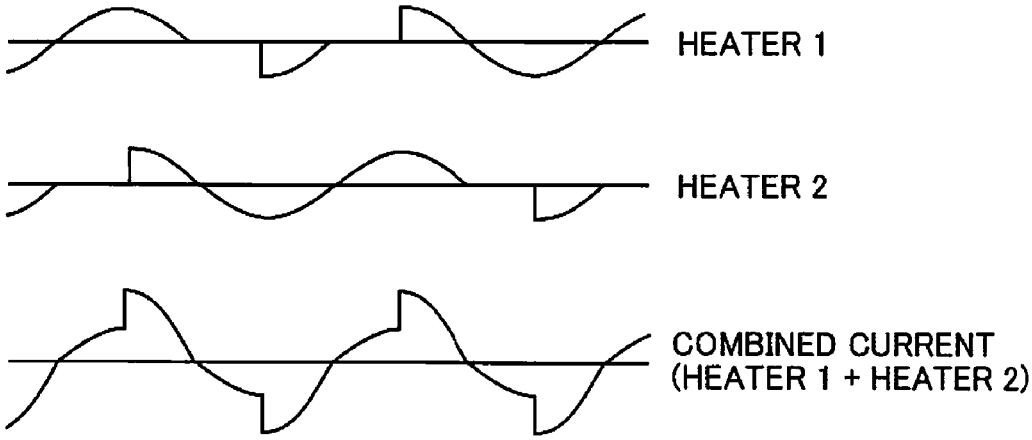
FIG. 5-A (c)
50%
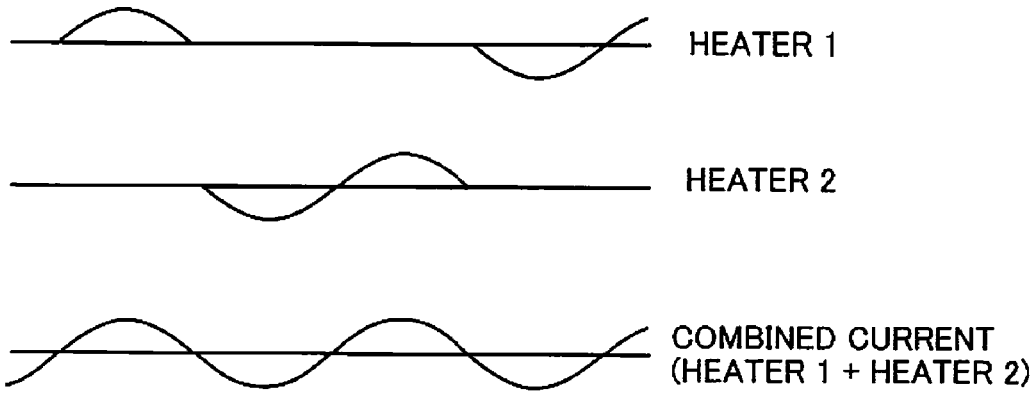

FIG. 5-B (d)
25%
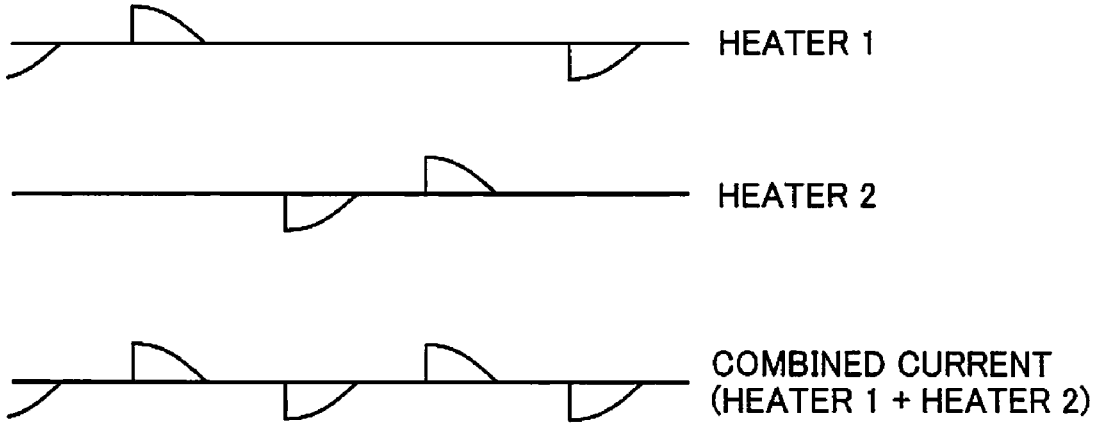
FIG. 5-B (e)
0%
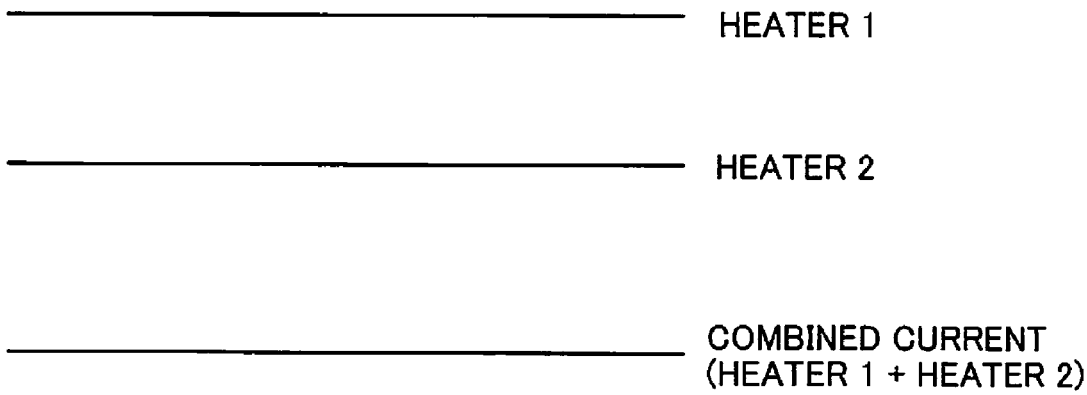

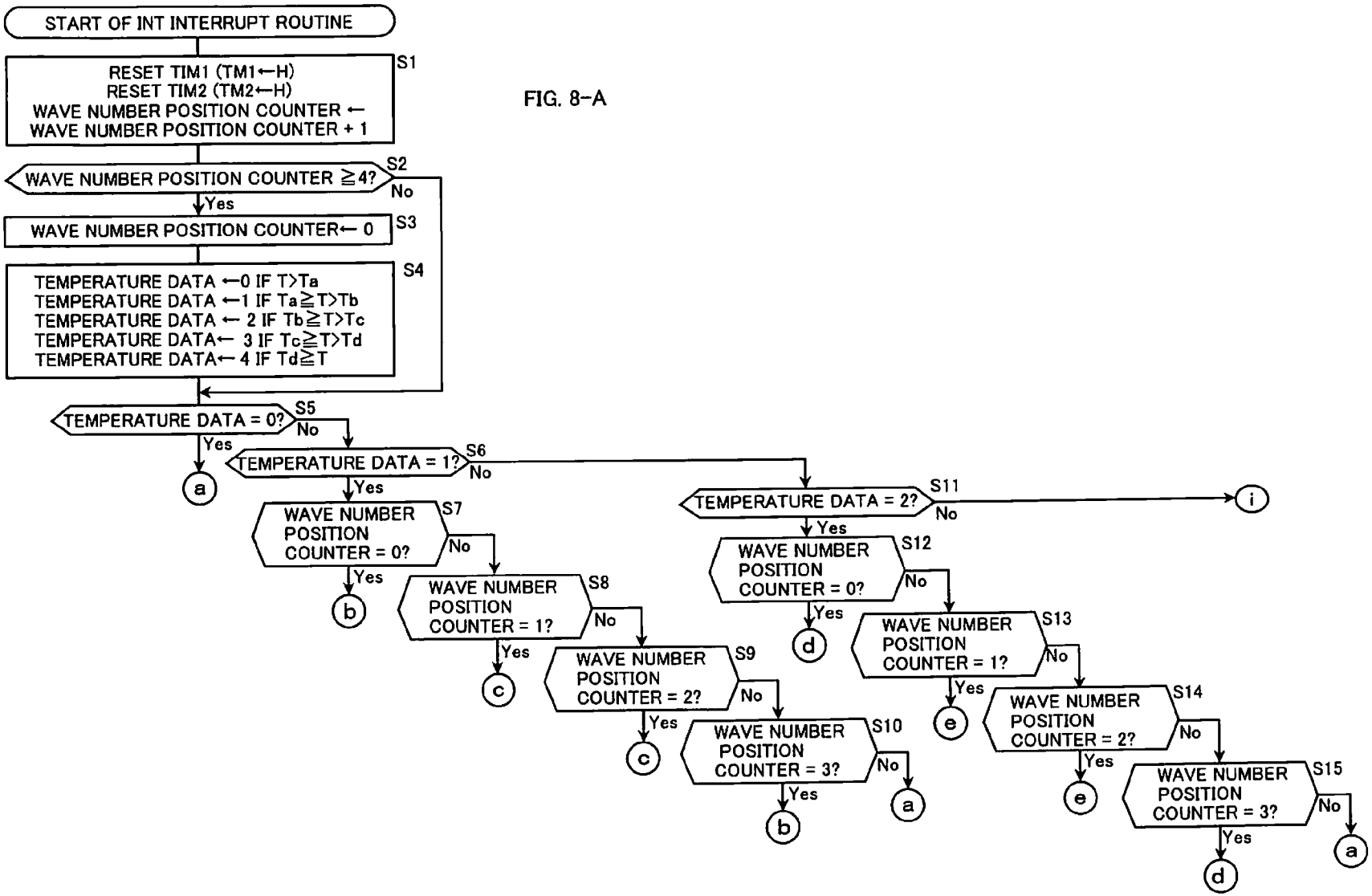
FIG. 8-A

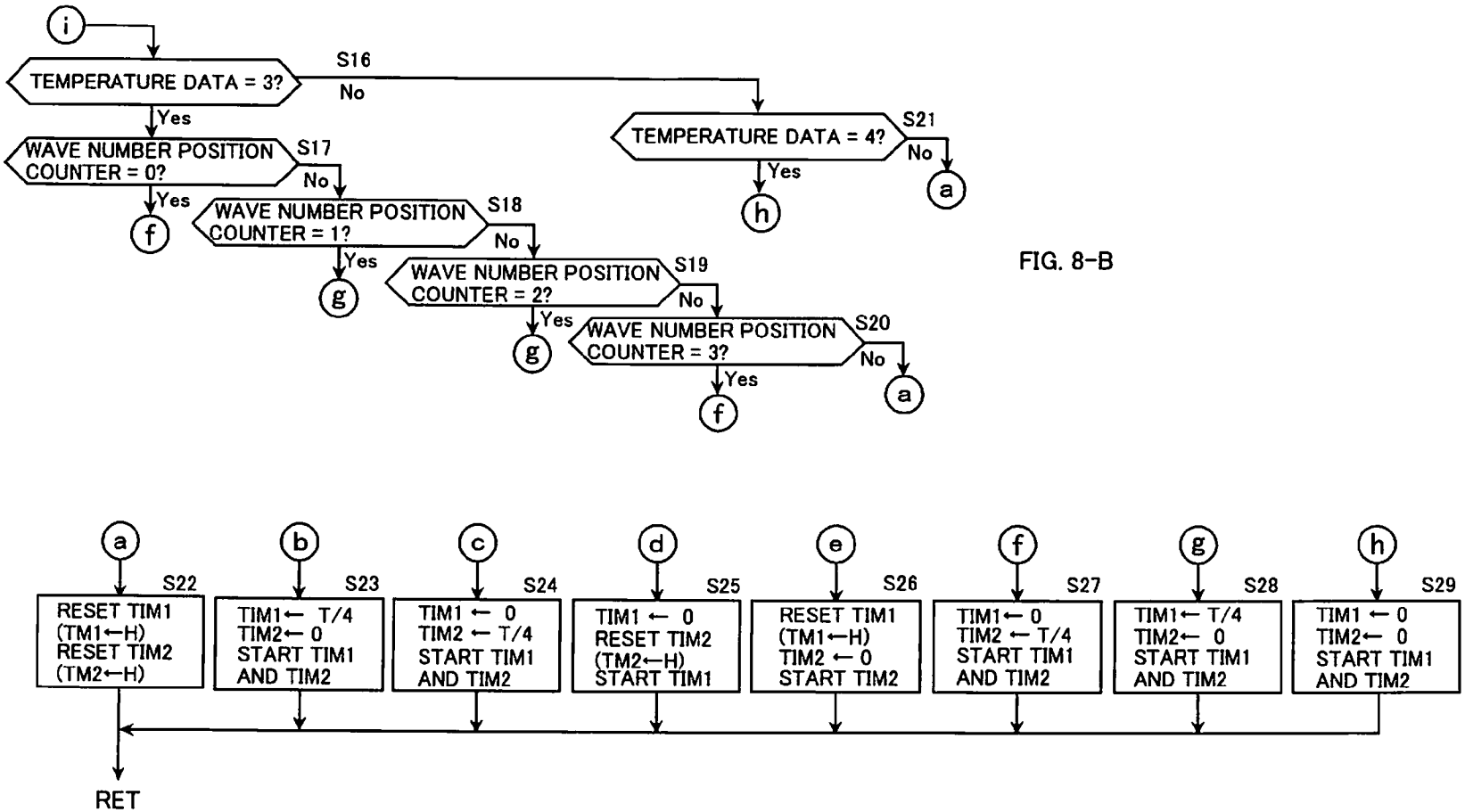
FIG. 8-B

FIXATION HEATER CONTROL METHOD AND IMAGE FORMATION DEVICE

TECHNICAL FIELD

The present invention relates to an image forming apparatus such as an electrostatic copier and a printer having a fixing device that fixes a toner image on paper, and more particularly to a fixing heater control method thereof.

BACKGROUND ART

Conventionally, those fixing heaters require a large amount of power and generate a large current fluctuation when the power is turned on or off. FIG. 1 is a general diagram showing a conventional fixing roller. A sheet of paper 3 is fed between a rotating heater roller 4 and a pressure roller 5 to heat and melt a toner image onto the paper. Heaters 1 and 2 are installed in the heater roller 4 as shown in the figure. The waveform shown in FIG. 2 is the waveform of the heater turn-on current when the ON/OFF is controlled based on temperature. P1 and P2 in the figure indicate the points of abrupt current fluctuations, which generate a fluctuation in the voltage of the supplied power and cause a flicker in a light connected to the same power supply.

FIG. 3 is a diagram showing a fluctuation in the voltage. In general, when a supplied power is viewed from the power outlet to which a power-connected device 8 (in this case, a copier) is connected, there is found low power supply impedance Rs. Therefore, the power voltage fluctuation, caused when the current consumption of the connected device 8 varies greatly and abruptly, is evaluated as the power voltage fluctuation $\Delta V = Rs \times \Delta I$ where $\Delta I$ is the change in the current. For example, when a light is connected to this outlet line and an abrupt voltage fluctuation occurs, the fluctuation causes a flicker in the light. It is known that the change in the current should be reduced to prevent such a flicker in the light.

Patent Document 1: Japanese Patent Laid-Open Publication No. Hei 11-95611

Patent Document 2: Japanese Patent Laid-Open Publication No. Hei 9-244466

DISCLOSURE OF THE INVENTION

The present invention reduces an abrupt current change caused when power is supplied to a heater used in a fixing device. More specifically, the present invention reduces the abrupt current changes indicated by points P1 and P2 in the ON/OFF periods of the waveform of the current supplied to the heater shown in FIG. 2.

One of the solutions is to perform common phase control that makes the current change almost ideal and smooth. However, because the turn-on switching point for each half wave starts not at a zero-cross point but at a point in the midst of the half-wave, the problem of an increase in the higher harmonic wave current occurs. This current, which has a frequency that is a multiple (several or several tens of times) of the power supply frequency, gives a spurious noise to other apparatuses connected to the power supply line, causing a malfunction or a failure.

The present invention proposes a method for improving the problem described above. In relation to this method, the inventor of the present invention proposed a method in a prior invention, in which the three-half-wavelength based wave number control and the phase control are combined (see Patent Document 1). The control of one heater is basically assumed in this prior invention, while the so-called dual heater control is proposed in an embodiment of the present invention where one heater is divided preferably into two heaters each with an equal capacity. The technology for a fixing heater using multiple heaters is already disclosed in Patent Document 2.

In view of the foregoing, it is an object of the present invention to provide a fixing heater control method and an image forming apparatus that uses this method, wherein the generation of a higher harmonic wave current and a power line terminal noise can be reduced by using novel phase control for the fixing heater.

It is another object of the present invention to provide a fixing heater control method and an image forming apparatus that uses this method, wherein the generation of a higher harmonic wave current and a power line terminal noise can be reduced by using novel phase control for the fixing heater that uses first and second heaters.

It is still another object of the present invention to provide a fixing heater control method and an image forming apparatus that uses this method, wherein the generation of a power-supply higher-harmonic-wave current in the control of the fixing heater can be suppressed and an abrupt current fluctuation at a turn-on time can be reduced.

A fixing heater control method according to the present invention is a fixing heater control method for performing a power on/off control of a fixing heater, wherein, with four consecutive half wavelengths (two cycles) of a power supply voltage employed as a period, two half waves are used for phase control and other two half waves are made full ON or full OFF for the fixing heater.

In another aspect, a fixing heater control method according to the present invention is a method for performing a power on/off control of a fixing heater comprising first and second heaters, wherein, with four consecutive half wavelengths (two cycles) of a power supply, two half waves are used for phase control and other two half waves are made full ON or full OFF for each of the first and second heaters and, at the same time, the phase control is performed complimentarily to both the heaters.

That is, for each half wave, when the power is turned on with the phase control of one heater, the other heater is made full ON or full OFF. This causes turn-on switching to occur only on at most one heater in a half wave period. As a result, as compared with usual phase control, a power-supply higher-harmonic-wave current and a power line terminal noise are reduced.

The fixing heater control method may further comprises the steps of sequentially detecting a temperature of the fixing heater to be heated; determining to which temperature range the detected temperature belongs, wherein the temperature range is one of at least three temperature ranges generated by dividing a whole temperature range by at least two thresholds, and allocating at least three power ON/OFF patterns, each having a different ON/OFF ratio, to the at least three temperature ranges for controlling the first and second heaters using the allocated power ON/OFF patterns. Each time the detected temperature exceeds one of the thresholds, the power ON/OFF pattern is switched from the current power ON/OFF pattern to the immediate next power ON/OFF pattern.

An image forming apparatus according to the present invention is an image forming apparatus having a fixing device for fixing a toner image on paper. The apparatus comprises a fixing heater built in the fixing device; switching means that controls an application of an alternate current power supply voltage to the fixing heater; temperature detection means that detects a temperature of the fixing heater; and control means that, with four consecutive half wavelengths (two cycles) of the power supply voltage employed as a period, uses two half waves for phase control and makes other two half waves full ON or full OFF, wherein the control means controls the switching means based on the temperature detected by the temperature detection means.

In another aspect, an image forming apparatus according to the present invention is an apparatus having a fixing device for fixing a toner image on paper. The apparatus comprises a fixing heater built in the fixing device and comprising first and second heaters; first and second switching means that control an application of an alternate current power supply voltage to the first and second heaters; temperature detection means that detects a temperature of the fixing heater; and control means that, with four consecutive half wavelengths (two cycles) of a power supply voltage employed as a period, uses two half waves for phase control and makes other two half waves full ON or full OFF for each of the first and second heaters and, at the same time, performs the phase control complimentarily to both the heaters, wherein the control means controls the first and second switching means based on the temperature detected by the temperature detection means.

In one embodiment of the control, the control means determines to which temperature range the temperature detected by the temperature detection means belongs, wherein the temperature range is one of at least three temperature ranges generated by dividing a whole temperature range by at least two thresholds, and allocates at least three power ON/OFF patterns, each having a different ON/OFF ratio, to the at least three temperature ranges for controlling the first and second heaters using the allocated power ON/OFF patterns.

EFFECTS OF THE INVENTION

The present invention provides a novel heater control method wherein, with four consecutive half wavelengths (two cycles) of a power supply voltage employed as a period, two half waves are used for phase control and other two half waves are made full ON or full OFF for the fixing heater. This method is advantageously applicable to the control of a fixing heater that uses first and second heaters. That is, with four consecutive half wavelengths (two cycles) of a power supply voltage employed as a period, two half waves are used for phase control and other two half waves are made full ON or full OFF for each of the first and second heaters and, at the same time, the phase control is performed complimentarily to both the heaters. Because this fixing heater control method allows the total ON/OFF ratio of both the heaters to be made variable continuously and makes the half waves, to which the phase control is applied, complimentary to both the heaters, the current change that cuts a half wave (that is, turn-on switching occurs in an intermediate position within a half wave period) is always the change for at most one heater. That is, because there is no time at which the current change that cuts a half wave occurs in the two heaters at the same time and because the amount of current change of turn-on switching of one heater is small, the reduction of the power-supply higher-harmonic-wave can be expected. In addition, though the power ON/OFF pattern of each heater has a four-half-wave period, each half wave has the same waveform (except positive and negative) and its period is one period as far as the waveform of the combined currents of both the heaters is concerned. Therefore, this heater control method is effective to reduce a flicker because there is not a periodic current change dependent on the basic period such as the one generated during the conventional wave number control operation.

BRIEF DESCRIPTION OF THE DRAWINGS

FIG. 5-A(*a*) to 5-A(*c*) are diagrams showing three typical power ON/OFF patterns which are generated based on pattern 1 shown in FIG. 4(*a*) and each of which has a different ON/OFF ratio.

FIGS. 5-B(*d*) and 5-B(*d*) are diagrams showing two typical power ON/OFF patterns which are generated based on pattern 2 shown in FIG. 4(*b*) and each of which has a different ON/OFF ratio.

FIG. 8-A is a flowchart showing the processing of the temperature control shown in FIG. 7.

FIG. 8-B is a flow chart showing the processing following the processing in FIG. 8-A.

DESCRIPTION OF REFERENCE NUMERALS

Figure 1:
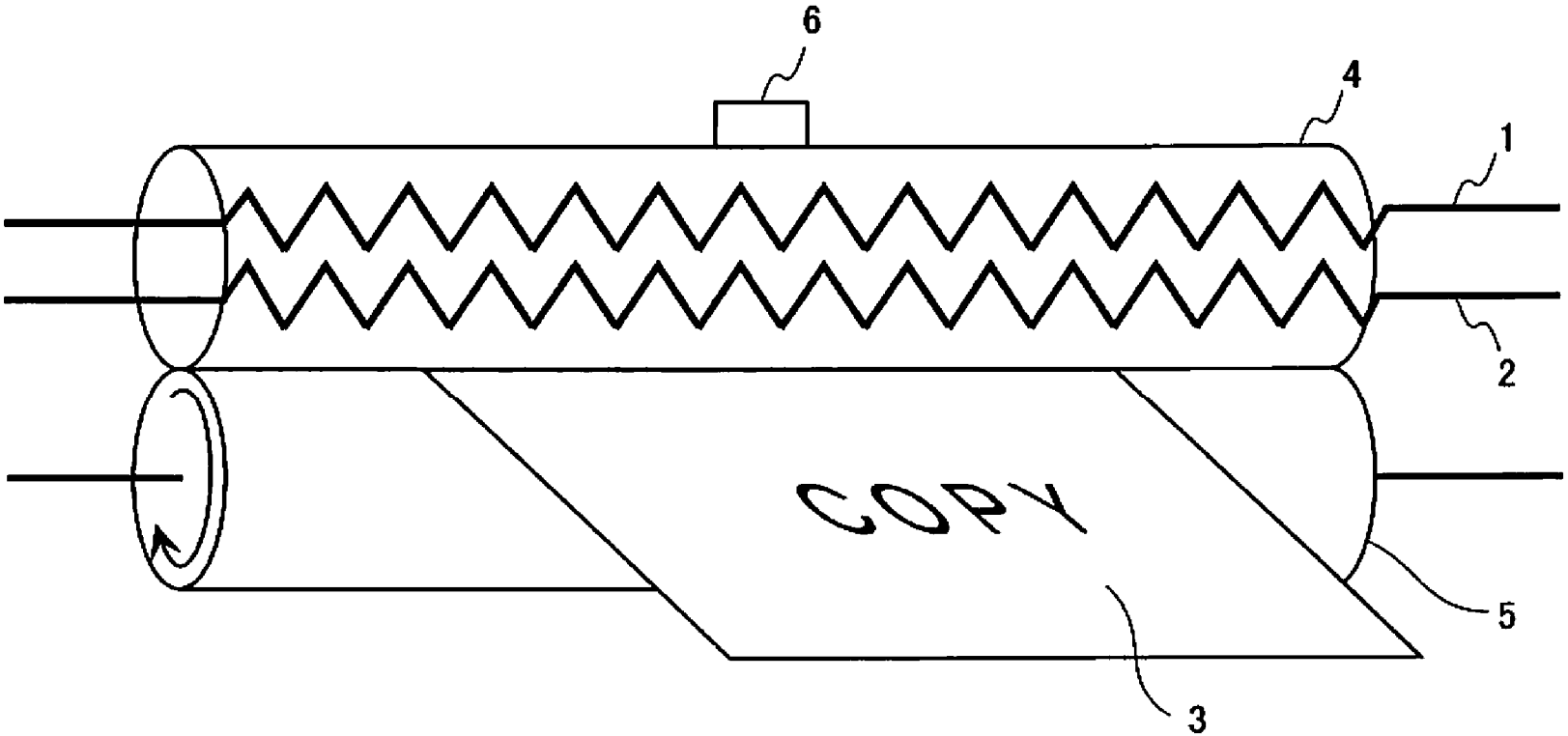
FIG. 1 is a diagram showing the general view of a conventional fixing roller.
Figure 2:
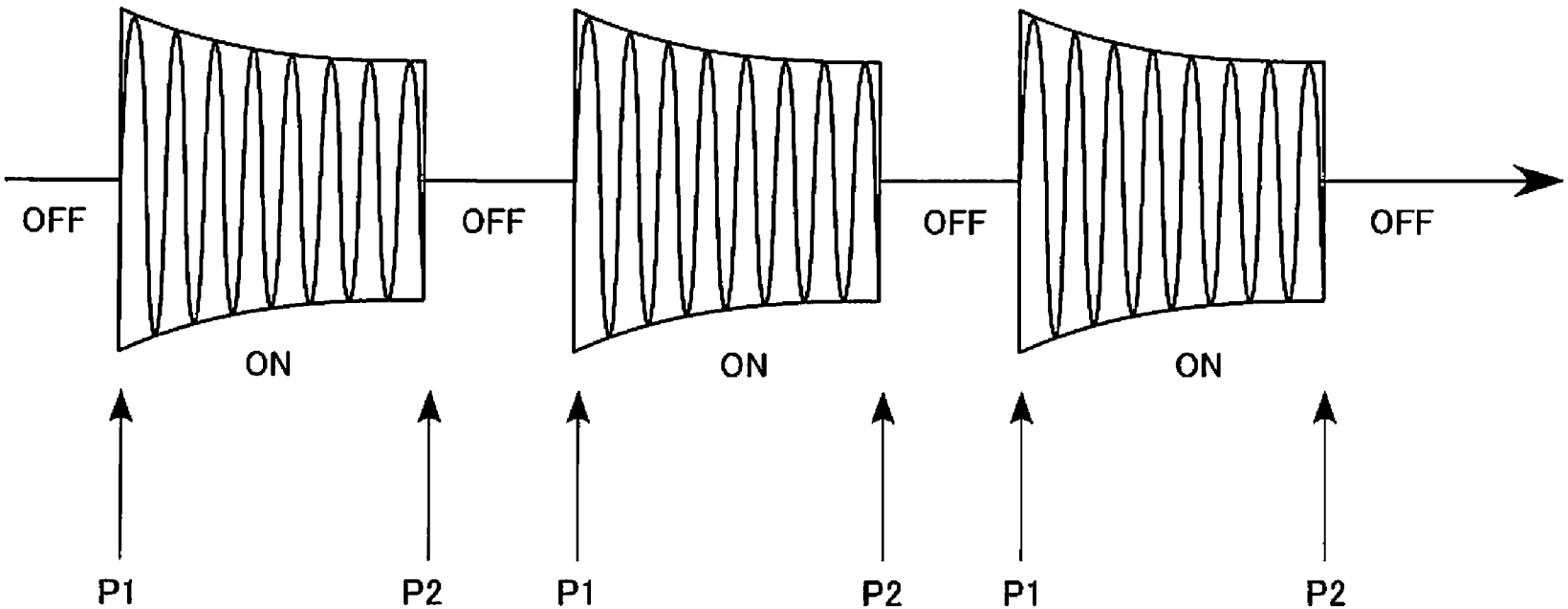
FIG. 2 is a waveform diagram showing the heater turn-on current waveform when the conventional ON/OFF temperature control is performed.
Figure 3:
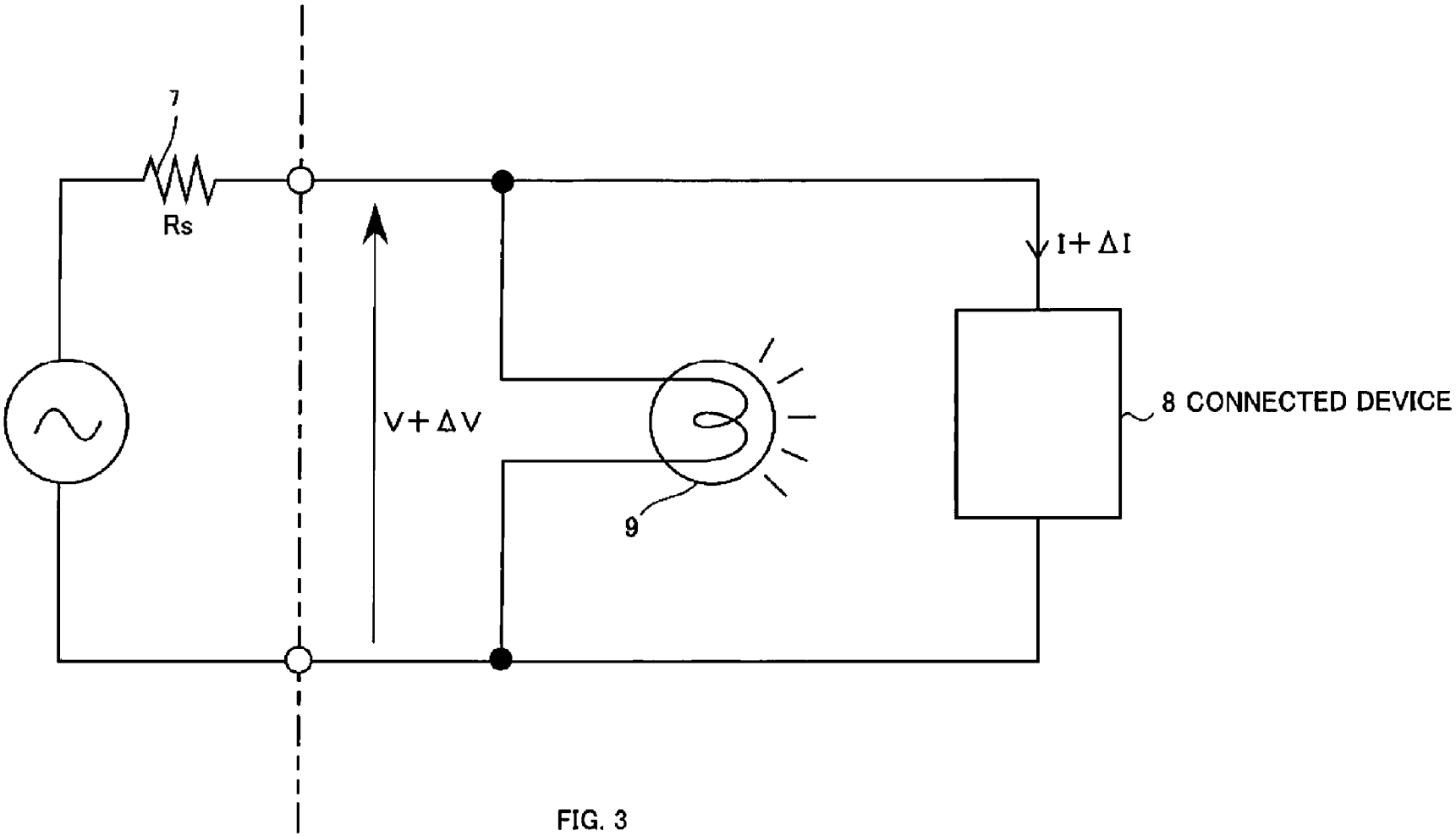
FIG. 3 is a diagram showing an adverse effect caused by a voltage fluctuation.

1, 2 . . . Heater (fixing heater)
3 . . . Paper
4 . . . Heater roller
5 . . . Pressure roller
6 . . . Temperature sensor
71 . . . Heater control unit
72 . . . Heater driving unit
73 . . . CPU
HT1, HT2 . . . Heater
PC1, PC2 . . . Photo-coupler
PT1, PT2 . . . Photo-triac
T1, T2 . . . Triac
TH . . . Thermistor
TIM1, TIM2 . . . Timer

BEST MODE FOR CARRYING OUT THE INVENTION

A preferred embodiment of the present invention will be described below in detail.

In this embodiment, the control of a fixing heater using two heaters, each with approximately the equal capacity, will be described (Note that this embodiment does not exclude the application to the control of a fixing heater that includes a single heater). The power ON/OFF patterns of the two heaters in this embodiment are divided into two: pattern 1 shown in FIG. 4(*a*) and pattern 2 shown in FIG. 4(*b*). Pattern 1 shows a case in which the ON/OFF ratio of both the heaters is 50% to 100%, while pattern 2 shows a case in which the ON/OFF ratio of both the heaters is 0% to 50%. The combination of power ON/OFF pattern a1 of the first heater and the power ON/OFF pattern b1 of the second heater in pattern 1 is the power ON/OFF pattern c1 that is the combined current of both the heaters. The combination of power ON/OFF pattern a2 of the first heater and the power ON/OFF pattern b2 of the second heater in pattern 2 is the power ON/OFF pattern c2 that is the combined current of both the heaters. The current amplitude of each heater is lower than the current amplitude of a conventional single heater that gives an equivalent thermal output.

The characteristic common to pattern 1 and pattern 2 is that, out of four consecutive half-wave periods that are the base (wave number positions 0-3), two half waves are allocated to the phase control and the other two half waves are allocated to a full ON or a full OFF. The two half waves allocated to the phase control are allocated complementarily to avoid a duplication between both the heaters. In other words, the phase control is not allocated simultaneously to the half waves in the same wave number position of both the heaters. The power allocated to one heater is balanced between positive power and negative power to prevent the so-called a DC operation. In the example in the figure, each of the phase angles P1, P2, P3, and P4 of the half waves, allocated to the phase control, is drawn 90° ahead of the zero-cross point in the immediate left side. Therefore, the ON/OFF ratio of both the heaters in the example in FIG. 4(*a*) is 75%. When the phase angles P1, P2, P3, and P4 are changed from 0° to 180°, the ON/OFF ratio is changed continuously from 100% to 50%.

Figure 4:
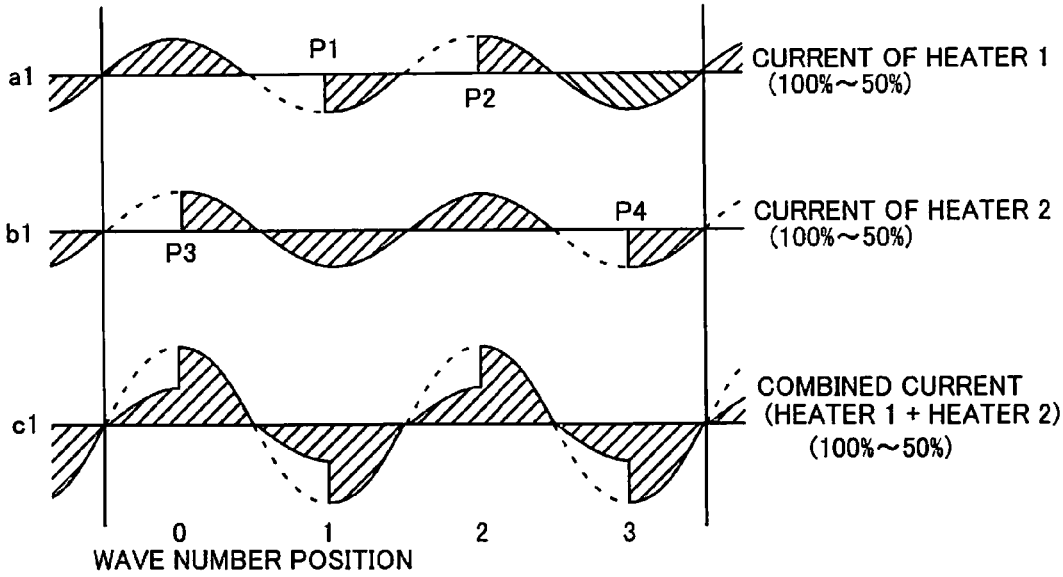
FIGS. 4(*a*) and 4(*b*) are diagrams showing pattern 1 and pattern 2 that are the power ON/OFF patterns of two heaters according to the present invention.
Figure 4:
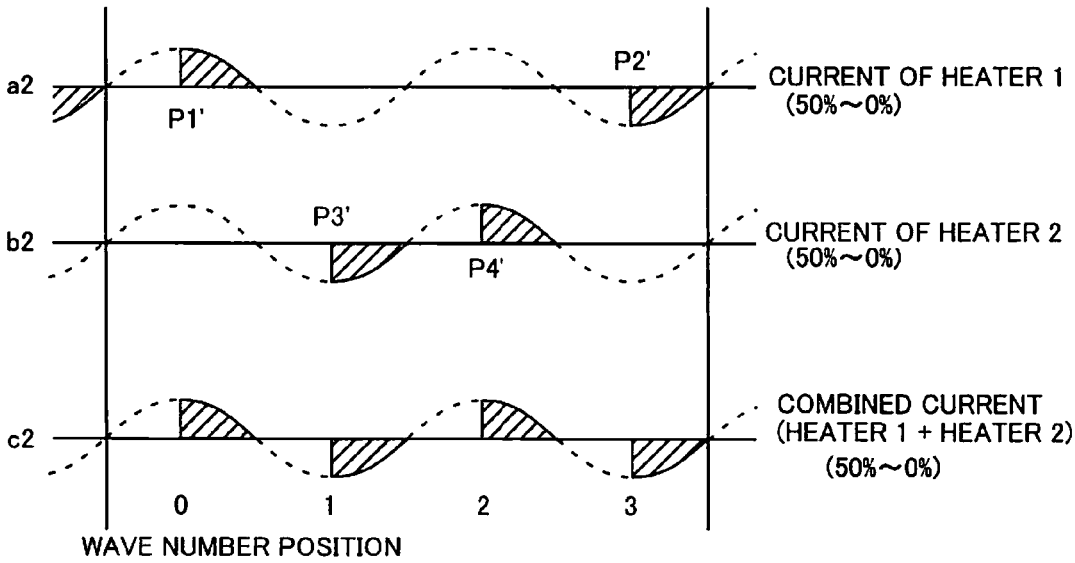

Basically, pattern 2 in FIG. 4(*b*) is generated by changing the full ON half-wave part of pattern 1 to full OFF. Therefore, when the phase angles P1', P2', P3', and P4' are changed from 0° to 180° ahead of the zero-cross point in the immediate left side, the ON/OFF ratio of both the heaters is changed continuously from 50% to 0%.

Therefore, combining pattern 1 and pattern 2 allows the turn-on current of the fixing heater to be changed continuously from 0% to 100%.

The characteristic point in this case is that, because the half wave parts that break the phase between 0° and 180° are allocated complementarily to both the heaters, the current change that cuts a half wave is equal to the change for at most one heater at any point. That is, there is no time at which the current change that cuts a half wave occurs in the two heaters at the same time and, therefore, the reduction of the power-supply higher-harmonic-wave can be expected. In addition, the waveforms of the combined current waveforms c1 and c2 indicate that the waveforms of the half waves are the same. Therefore, a periodic current change dependent on the basic period, such as the one generated during the wave number control operation, is not generated and flicker is reduced.

FIG. 5-A(*a*) to 5-A(*c*) and FIG. 5-B(*d*), 5-B(*e*) show five typical power ON/OFF patterns, each of which has a different ON/OFF ratio, generated based on pattern 1 and pattern 2 shown in FIGS. 4(*a*) and 4(*b*). FIG. 5-A(*a*) shows a case in which the phase angle of pattern 1 is set to 0° to set the ON/OFF ratio to 100%. In this case, both heater 1 and heater 2 are full ON. FIG. 5-A(*b*) shows a case in which the phase angle of pattern 1 is set to 90° to set the ON/OFF ratio to 75%. In this case, two half waves of the four consecutive half wavelengths of each heater is full ON and the remaining two half waves are used for the phase control, and the allocation is complementary to both the heaters. The combined current of both the heaters has the same shape every other half wave as shown in the figure, and there is not a periodic current fluctuation such as the one generated during the wave number control operation. FIG. 5-A(*c*) shows a case in which the phase angle of pattern 1 is set to 180° (or the phase angle of pattern 2 is set to 0°) to set the ON/OFF ratio to 50%. In this case, two half waves of the four consecutive half wavelengths of each heater is full ON, and the allocation is complementary to both the heaters. FIG. 5-B(*d*) shows a case in which the phase angle of pattern 2 is set to 135° to set the ON/OFF ratio to 25%. In this case, two half waves of the four half waves are used for the phase control (90°) and the other two half waves are full OFF. FIG. 5-B(*e*) shows a case in which the phase angle of pattern 2 is set to 180° to set the ON/OFF ratio to 0%. In this case, both the heaters are full OFF in all half-wave periods. It is easily understood that the ON/OFF ratios other than those five power ON/OFF patterns can be implemented by continuously changing the phase angle of the phase control.

Turn-on switching occurs in all half-wave periods for any ON/OFF ratio other than 100% and 0% in the conventional phase control, whereas no turn-on switching occurs for the ON/OFF ratio of 50% in this embodiment as shown in FIG. 5-A(*c*). In addition, as shown in FIG. 5-A(*b*), though turn-on switching occurs in each half-wave period when the ON/OFF ratio is higher than 50% but lower than 100%, the current change is equal to the amplitude of one heater, which is one of two divided heaters, even when the current change is the highest at the ON/OFF ratio of 75%. This means that the current change is reduced to the half of the maximum current change of one conventional heater (at the ON/OFF ratio of 50%). As shown in FIG. 5-B(*d*), though turn-on switching occurs in each half-wave period when the ON/OFF ratio is higher than 0% but lower than 50%, the current change is equal to the amplitude of one heater, which is one of two divided heaters, even when the current change is the highest at the ON/OFF ratio of 25%. This means that the current change is reduced to the half of the maximum current change of one conventional heater (at the ON/OFF ratio of 50%).

Figure 6:
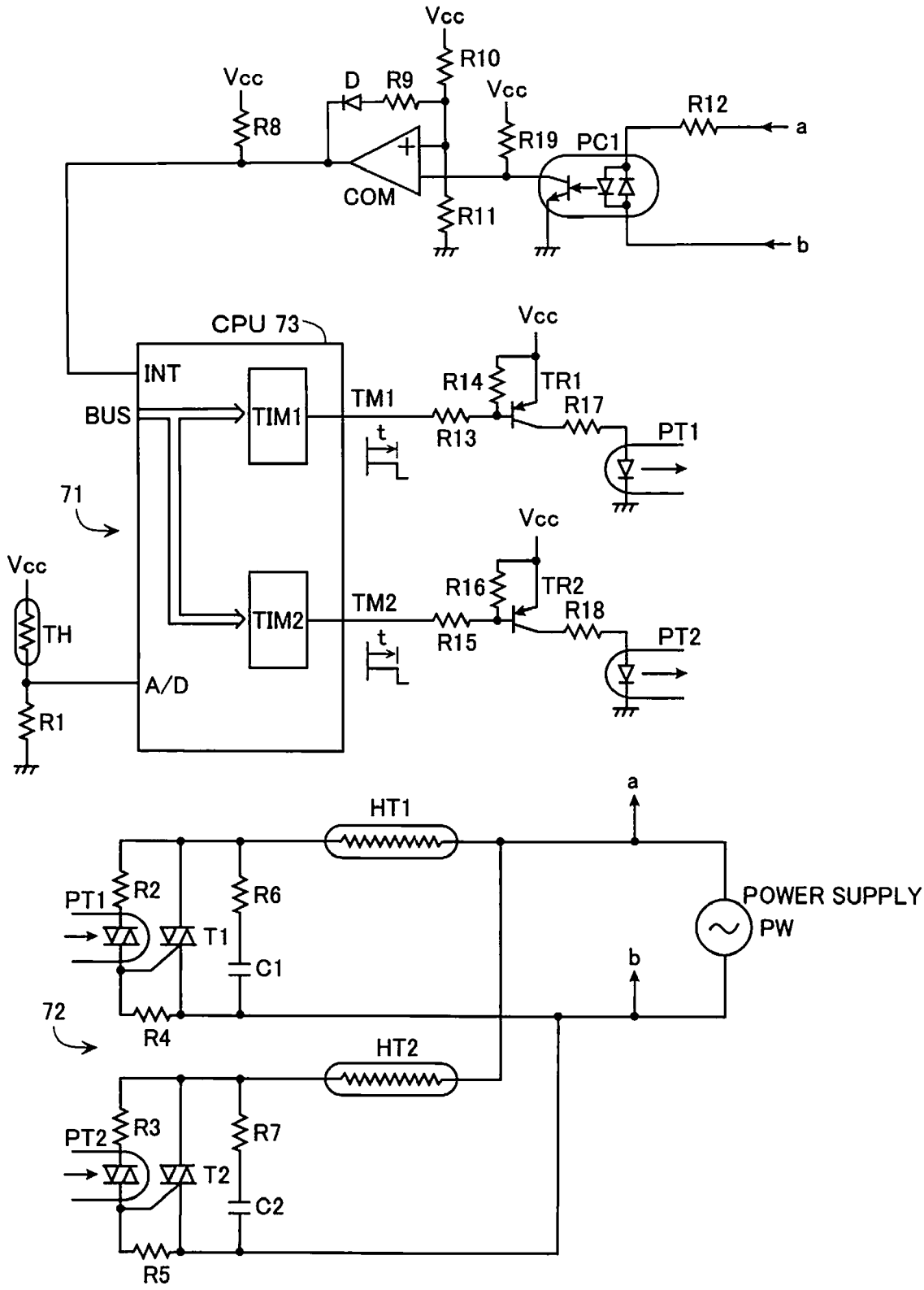
FIG. 6 is a circuit diagram showing the control circuit for implementing the control in this embodiment.

FIG. 6 is a circuit diagram showing a control circuit for implementing the control in this embodiment described above. This control circuit is divided roughly into a heater driving unit 72 for driving each of two heaters, HT1 and HT2, and a heater control unit 71 for controlling the heater driving unit 72.

In the heater driving unit 72, the heaters HT1 and HT2 are connected to an AC power supply PW, and their conduction states are controlled by triacs T1 and T2. The conduction state of triacs T1 and T2 is controlled by the light-receiving side of photo-triacs PT1 and PT2. A series circuit, connected in parallel to the triac T1 and composed of a resistor R6 and a capacitor C1, is a snubber circuit that prevents the triac T1 from being turned on independently when an abrupt power-supply voltage change occurs due to an external noise. A series circuit, connected in parallel to the triac T2 and composed of a resistor R7 and a capacitor C2, is also a snubber circuit that has the same function.

The heater control unit 71 has a CPU 73 that issues timer output signals TM1 and TM2 based on an input signal to an interrupt terminal INT and an analog input voltage to an analog/digital conversion input terminal A/D and based on internal timers TIM1 and TIM2. The timers TIM1 and TIM2 are circuits that output the driving signals of transistors TR1 and TR2 to the timer outputs TM1 and TM2 at a predetermined timing relative to the zero-cross point as will be described. The input signals, such as a signal which sets/resets data in the timers TIM1 and TIM2 and the clock signal, are omitted in the figure. The timers TIM1 and TIM2 can be implemented by hardware or software.

The analog/digital conversion input terminal A/D receives a divided potential, generated by dividing the power supply voltage Vcc by a thermistor temperature sensor (numeral 6 in FIG. 1) TH, which senses the temperature of a heater roller (numeral 1 in FIG. 1), and a resistor R1. The voltage signal sent to the A/D terminal is converted from analog to digital and the result is processed in the CPU 73. The INT input terminal of the CPU 73 receives a zero-cross pulse that is detected by a zero-cross detection circuit, composed of a resistor R12, a photo-coupler PC1, a comparator COM, resistors R8-R11, and a diode D, based on the power supply voltage.

The timer output TM1 of the CPU 73 controls the light-emitting side of the photo-triac PT1 via the driving circuit composed of the transistor TR1 and resistors R13, R14, and R17. Similarly, the timer output TM2 of the CPU 73 controls the light-emitting side of the photo-triac PT2 via the driving circuit composed of the transistor TR2 and resistors R15, R16, and R18.

The CPU 73 starts the interrupt routine (that will be described later) in the program, stored in the memory of the CPU 73 and corresponding to the flowcharts shown in FIGS. 8-A and 8-B, when the zero-cross signal falls. Immediately after the zero-cross signal falls, this routine resets the timers TIM1 and TIM2, sets their outputs TM1 and TM2 to H (high level), sets the delay timer value t in this routine, and starts the timers. After a predetermined time t has elapsed after the start, the timers TIM1 and TIM2 set their timer outputs TM1 and TM2 to L (low level) . This turns on the transistor TR1 or TR2 and generates the heater turn-on signal. More specifically, if the TM1 output is at the H level, the transistor TR1 is turned off and the light-emitting side of the photo-triac PT1 is turned off. Because the light-receiving side of the photo-triac PT1 is also off, the gate current of the triac T1 does not flow. Therefore, the triac T1 is turned off and the heater HT1 is turned off. When the TM1 output becomes the L level, the operation opposite to the one described above is performed; that is, the transistor TR1 is turned on, the light-emitting diode of the photo-triac PT1 is turned on, and the light-receiving side of the photo-triac PT1 is turned on. Because the light-receiving side of PT1 conducts, the gate current limited by the resistor R2 or R4 is supplied to the gate of the triac T1. As a result, the triac T1 conducts and the heater HT1 is turned on. The operation of the circuit where the other timer output TM2 flows through the transistor TR2, the photo-triac PT2, the triac T2, and the heater HT2 is the same.

Next, the following describes a specific fixing heater control method in which multiple power ON/OFF patterns described above are used. An example is shown below in which the five power ON/OFF patterns described above are applied to the heater control method previously proposed by the inventor of the present invention in Japanese Patent Application No. 2000-237162.

Usually, a continuous temperature adjustment is made in a fixing device to maintain the temperature of the heater roller at a predetermined temperature. Although this predetermined temperature varies according to the operation mode at the copy time or the standby time, whether the heater is to be turned on or off is determined in any case by comparing the temperature of the heater roller with a predetermined value (threshold). That is, when the temperature falls below the predetermined value, the heater ON signal is output; when the temperature exceeds one of the predetermined values, the heater OFF signal is output. The threshold may vary between when the temperature rises and when the temperature falls (that is, allow for hysteresis) but, in any case, the conventional heater is controlled basically by the two-value (bi-level) control method.

On the other hand, the prior invention described above provides a novel heater control method that controls the temperature more precisely and reduces the current fluctuation (flicker value) during the temperature adjustment. The fixing heater in the prior invention uses a single heater and the turn-on control is performed on a half wave basis to control the heater, while the power ON/OFF patterns using the partial phase control described above is applied to the dual heater configuration in this embodiment.

Figure 7:
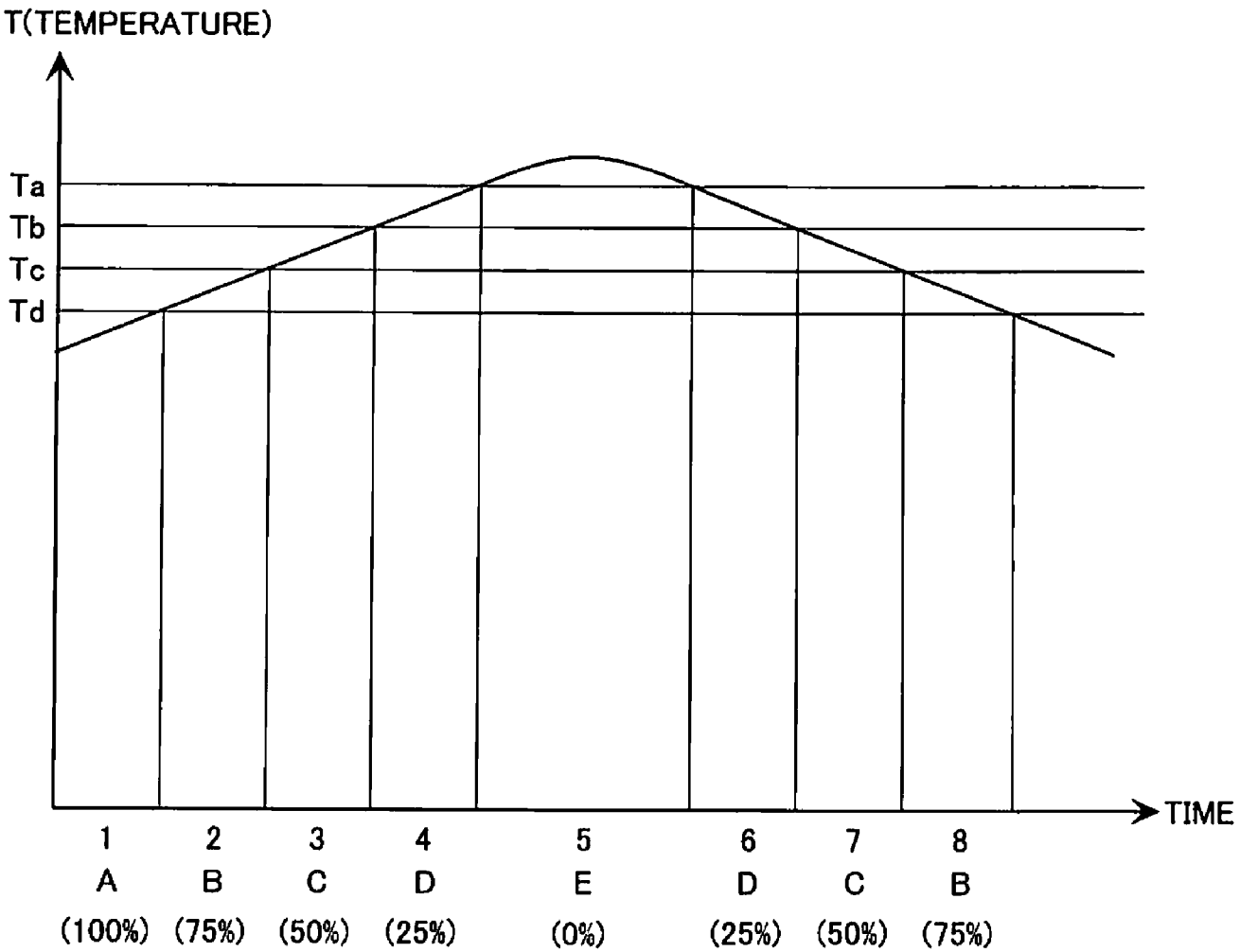
FIG. 7 is a graph showing the transition of the temperature control of the fixing heater that uses the above-described five power ON/OFF patterns in the embodiment of the present invention.

FIG. 7 is a graph showing the transition of the temperature control of a fixing heater using the five power ON/OFF patterns described above in this embodiment. The four levels of temperature threshold, Ta, Tb, Tc, and Td, are used to compare the measured temperature of a heater roller with the threshold where Td<Tc<Tb<Ta. In interval 1 in the figure where the temperature is equal to or lower than Td, pattern (a) of the ON/OFF ratio 100% is used to raise the temperature more quickly. In intervals 2 and 8 where the temperature T is Td<T<=Tc, pattern (b) of the ON/OFF ratio 75% is used. In intervals 3 and 7 where the temperature T is Tc<T<=Tb, pattern (c) of the ON/OFF ratio 50% is used. In intervals 4 and 6 where the temperature T is Tb<T<=Ta, pattern (d) of the ON/OFF ratio 25% is used. In interval 5 where the temperature T is Ta<T, pattern (e) of the ON/OFF ratio 0% is used. In this way, the control shown in FIG. 7 is performed in such a way that the ON/OFF ratio is reduced when the temperature rises and, conversely, the ON/OFF ratio is raised when the temperature falls. In one example of the temperature transition shown in FIG. 7, the pattern is changed in intervals 1-8 in sequence of (a)->(b)->(c)->(d)->(e)->(d)->(c)->(b) and, as a result, the temperature T is kept constant.

Just as described, the range of a whole temperature range for heating the heater is divided into five temperature ranges using four thresholds, and one of five different power ON/OFF patterns (five values) is allocated to each of the divided temperature ranges. As compared with the conventional bi-level (ON/OFF) control method, the control method in this embodiment makes it possible to perform highly precise temperature control and, because the ON/OFF ratio is changed 25% at a time, to reduce the flicker value because the current fluctuation is reduced.

Note that the number of multiple values need not be 5 but that any number equal to or higher than 3 can be used. Also note that the present invention is characterized in the power ON/OFF patterns described above but that the multiple-value control is not always required for the present invention.

With reference to the flowcharts in FIG. 8-A and FIG. 8-B, the following describes the procedure to implement the control described above. First, this INT interrupt routine is started each time the zero-cross signal is input to the INT terminal of the CPU 73 in the circuit diagram in FIG. 6, and the routine is executed by the CPU 73. In the first step S1 of this routine, the timers TIM1 and TIM2 are cleared and their outputs TM1 and TM2 are set to H. Next, the wave number position counter, which identifies each half wave position of the four consecutive half waves, is incremented by 1. Next, in the checking step S2, whether this counter value reaches 4 is checked. If the counter value is 4, the wave number position counter is cleared to 0. In this way, the counter value is counted up at each interrupt for counting cyclically from 0 to 3. Therefore, this numeric value indicates the position of the half wave at the processing time. The temperature is checked each time the wave number position counter is cleared and, if the temperature T>Ta in procedure step S4, 0 is set in the temperature data as the indicator. Similarly, 1 is set in the temperature data if Ta=>T>Tb, 2 is set in the temperature data if Tb=>T>Tc, 3 is set in the temperature data if Tc=>T>Td, and 4 is set in the temperature data if Td=>T.

After the processing described above, a check is made in checking step S5 if the temperature data is 0, that is, if the temperature T>Ta. If so, both TM1 and TM2 are reset in processing step S22 and their outputs are both fixed to H. In the circuit operation, this processing turns off both the heater HT1 and the heater HT2.

In step S6, a check is made if the temperature data is 1. That is, if the temperature Ta=>T>Tb, a check is made, in checking steps S7, S8, S9, and S10 to determine the wave number position of one of the four consecutive half waves to be processed. For example, if the wave number position is 0 in checking step S7, the position corresponds to the first half wave (wave number position 0) of pattern 2 in FIG. 4(*b*). In this case, control is passed to processing step S23, and the time of the ¼ period (½ half wave), that is, the time T/4 corresponding to the phase of 90°, is set in the timer TIM1. The time of 0 is set in the timer TIM2. After that, when both timers are started, the timer TIM1 times out after the time T/4 and, at that time, the timer output TM1 is changed from H to L. On the other hand, the timer TIM2, in which 0 is set, times out immediately after started. Therefore, the timer output TM2 is changed from H to L immediately after the timer is started. This results in generating the signal of the first half wave (wave number position 0) of pattern 2 in FIG. 4(*b*).

After that, when an interrupt occurs, control is passed to checking steps S8, S9, and S10 and thus the half wave waveform is generated at wave number positions 1, 2, and 3. The same processing is performed when the temperature data is 2 (S11-S15), 3 (S16-S20), and 4 (S21).

While an embodiment of the present invention has been described, it will be understood that the present invention is not limited to those mentioned above but that various modifications and changes can be made.

A switch may be installed on the housing to allow the operator to easily select between the left and the right and a semi-transparent hood may be installed on the side end to enable the device to be applied to an application in which a high brightness is required and the operator cannot look directly at the input position.

INDUSTRIAL APPLICABILITY

The present invention is applicable to the setting, development, and manufacturing of an image forming apparatus having a fixing device that fixes a toner image on paper.

The invention claimed is:

1. A fixing heater control method for performing a power on/off control of a fixing heater;

wherein, with four consecutive half wavelengths (two cycles) of a power supply voltage employed as a period, two half waves are used for phase control and other two half waves are made full ON or full OFF for said fixing heater.

2. A fixing heater control method for performing a power on/off control of a fixing heater comprising first and second heaters;

wherein, with four consecutive half wavelengths (two cycles) of a power supply voltage employed as a period, two half waves are used for phase control and other two half waves are made full ON or full OFF for each of the first and second heaters and, at the same time, the phase control is performed complimentarily to both the heaters.

3. The fixing heater control method according to claim 2, said method comprising the steps of:

sequentially detecting a temperature of the fixing heater to be heated;

determining to which temperature range the detected temperature belongs, wherein said temperature range is one of at least three temperature ranges generated by dividing a whole temperature range by at least two thresholds, and allocating at least three power ON/OFF patterns, each having a different ON/OFF ratio, to said at least three temperature ranges for controlling said first and second heaters using the allocated power ON/OFF patterns.

4. An image forming apparatus having a fixing device for fixing a toner image on paper, said apparatus comprising:

a fixing heater built in said fixing device;

switching means that controls an application of an alternate current power supply voltage to said fixing heater;

temperature detection means that detects a temperature of said fixing heater; and control means that, with four consecutive half wavelengths (two cycles) of the power supply voltage employed as a period, uses two half waves for phase control and makes other two half waves full ON or full OFF, wherein said control means controls said switching means based on the temperature detected by said temperature detection means.

5. An image forming apparatus having a fixing device for fixing a toner image on paper, said apparatus comprising:

a fixing heater built in said fixing device and comprising first and second heaters;

first and second switching means that control an application of an alternate current power supply voltage to said first and second heaters;

temperature detection means that detects a temperature of said fixing heater; and control means that, with four consecutive half wavelengths (two cycles) of a power supply voltage employed as a period, uses two half waves for phase control and makes other two half waves full ON or full OFF for each of the first and second heaters and, at the same time, performs the phase control complimentarily to both the heaters;

wherein said control means controls said first and second switching means based on the temperature detected by said temperature detection means.

6. The image forming apparatus according to claim 5, wherein said control means determines to which temperature range the temperature detected by said temperature detection means belongs, wherein said temperature range is one of at least three temperature ranges generated by dividing a whole temperature range by at least two thresholds, and allocates at least three power ON/OFF patterns, each having a different ON/OFF ratio, to said at least three temperature ranges for controlling said first and second heaters using the allocated power ON/OFF patterns.

* * * * *